US011450520B2

(12) United States Patent
Senko et al.

(10) Patent No.: US 11,450,520 B2
(45) Date of Patent: Sep. 20, 2022

(54) APPARATUS AND METHOD FOR PERFORMING CHARGE DETECTION MASS SPECTROMETRY

(71) Applicant: Thermo Finnigan LLC, San Jose, CA (US)

(72) Inventors: Michael W. Senko, Sunnyvale, CA (US); Jesse D. Canterbury, Shoreline, WA (US)

(73) Assignee: Thermo Finnigan LLC, San Jose, CA (US)

( * ) Notice: Subject to any disclaimer, the term of this patent is extended or adjusted under 35 U.S.C. 154(b) by 0 days.

(21) Appl. No.: 15/734,124

(22) PCT Filed: May 24, 2019

(86) PCT No.: PCT/US2019/034009
§ 371 (c)(1),
(2) Date: Dec. 1, 2020

(87) PCT Pub. No.: WO2019/231854
PCT Pub. Date: Dec. 5, 2019

(65) Prior Publication Data

US 2021/0210331 A1 Jul. 8, 2021

Related U.S. Application Data

(60) Provisional application No. 62/679,287, filed on Jun. 1, 2018.

(51) Int. Cl.

| | |
|---|---|
| ***H01J 49/42*** | (2006.01) |
| ***H01J 49/00*** | (2006.01) |
| ***H01J 49/02*** | (2006.01) |

(52) U.S. Cl.
CPC ..... *H01J 49/425* (2013.01); *H01J 49/0031* (2013.01); *H01J 49/027* (2013.01)

(58) Field of Classification Search
CPC ..... H01J 49/425; H01J 49/0031; H01J 49/027
(Continued)

(56) References Cited

U.S. PATENT DOCUMENTS

2016/0233078 A1 8/2016 Hauschild et al.
2020/0395202 A1 12/2020 Richardson et al.

OTHER PUBLICATIONS

Contino et al. "Charge Detection Mass Spectrometry with Resolved Charge States", American Society for Mass Spectrometry (2013) 24:101-108 (Year: 2013).*

(Continued)

*Primary Examiner* — Nicole M Ippolito

(57) ABSTRACT

Apparatus and methods for performing charge detection mass spectrometry are disclosed. An analyte ion is injected into an electrostatic trap, which has electrodes shaped and arranged to establish a trapping field that causes the analyte ion to undergo harmonic motion along a longitudinal axis. A time-varying signal is generated by a detector representative of the harmonic motion. A data system processes the time-varying signal to derive the frequency of ion motion and the amplitude at the harmonic motion frequency, and determines the mass-to-charge ratio (m/z) of the ion based on the derived frequency and the charge from the derived amplitude. The product of the experimentally determined m/z and charge yields the mass of the analyte ion. The electrodes preferably include an elongated inner electrode surrounded by an outer electrode, forming an orbital or non-orbital electrostatic trap.

17 Claims, 3 Drawing Sheets

(58) Field of Classification Search
USPC ..... 250/281, 282, 283, 286, 287
See application file for complete search history.

(56) References Cited

OTHER PUBLICATIONS

Elliot et al. "Single Particle Analyzer of Mass: A Charge Detection Mass Spectrometer with a Multi-Detector Electrostatic Ion Trap", International Journal of Mass Spectrometry, Mar. 2017; 414: pp. 45-55 (Year: 2017).*
"Charge Detection Mass Spectrometry with Resolved Charge States", American Society for Mass Spectrometry (2013) 24:101-108 (Year: 2013).*
"Single Particle Analyzer of Mass: A Charge Detection Mass Spectrometer with a Multi-Detector Electrostatic Ion Trap", International Journal of Mass Spectrometry, Mar. 2017; 414: pp. 45-55 (Year: 2017).*
Contino et al., "Charge detection mass spectrometry for single ions with a limit of detection of 30 charges", International Journal of Mass Spectrometry 345-347 (2013), pp. 153-159.
Contino et al., "Charge Detection Mass Spectrometry with Resolved Charge States", J. Am. Soc. Mass Spectrom. (2013), 24, pp. 101-108.
Makarov, et al., "Dynamics of Ions of Intact Proteins in the Orbitrap Mass Analyzer", J Am Soc Mass Spectrom 2009, 20, pp. 1486-1495.
Rose et al., "High-sensitivity Orbitrap mass analysis of intact macromolecular assemblies", Nature Methods, vol. 9(11), 2012, pp. 1084-1088.
Schmidt et al., "Conetrap: A compact electrostatic ion trap", Nuclear Instruments and Methods in Physics Research B 173 (2001), pp. 523-527.
Wen-Ping et al., "Measuring masses of large biomolecules and bioparticles using mass spectrometric techniques", Analyst, 2014, 139, pp. 3507-3523.

* cited by examiner

APPARATUS AND METHOD FOR PERFORMING CHARGE DETECTION MASS SPECTROMETRY

BACKGROUND OF THE INVENTION

Field of the Invention

The invention relates generally to mass spectrometry, and more particularly to an apparatus and method for measurement of the mass-to-charge ratio and charge of a single ion.

Description of Related Art

Charge detection mass spectrometry (CDMS) is a technique where the masses of individual ions are determined from concurrent measurement of each ion's mass-to-charge ratio (m/z) and charge. One technique used in academic laboratories for CDMS, referred to as ion trap CDMS, employs an inductive detector positioned between two opposing electrostatic mirrors, as described in Fuerstenau and Benner, "Molecular weight determination of megadalton DNA electrospray ions using charge detection time-of-flight mass spectrometry", Rapid Communications in Mass Spectrometry 9:15 (1995), 1528-1538. In such instruments, an ion's m/z is determined by its oscillation frequency between the mirrors, while its charge is determined based upon the amplitude of the signal on the inductive detector. Separate and direct measurement of the charge thus overcomes a common challenge for large and/or heterogeneous analytes investigated with conventional electrospray mass spectrometry, where it may not be possible to separate incrementally charged ion species and thereby infer charge state.

Existing ion trap CDMS instrumentation presents several significant technical challenges. First, because the potential generated by opposing mirrors is generally anharmonic, the measured frequency is dependent on the initial kinetic energy of the ion. This may lead to poor m/z measurement accuracy for single particles, which also results in poor resolution when assembling a histogram of measured mases. In addition, the signal generated by the inductive detector is not sinusoidal, but processing of the signal is performed using Fourier transform analysis. The resultant signal is distributed among numerous harmonics, which significantly reduces overall system sensitivity. This imposes an additional restriction where only a single ion species can be analyzed at a time, leading to very long acquisition cycles. Finally, ions are moved directly in existing CDMS instrumentation from the source to the mirrors, without proper desolvation. The lack of desolvation may result in the observation of mass shifts during the measurement period as the ion loses solvent.

Against this background, there is a need in the art for an apparatus and method for concurrent determination of an ion's m/z and charge that avoids the problems arising in prior art devices associated with anharmonic ion motion and incomplete desolvation.

SUMMARY OF THE INVENTION

Roughly described, an apparatus and corresponding method are disclosed for measurement of the m/z and charge of an ion, and consequently its mass, by detection of the frequency and amplitude of an image current signal induced by the ion's oscillatory movement within an electrostatic trap. The electrostatic trap includes a plurality of electrodes to which non-oscillatory voltages are applied. The electrodes are shaped and arranged to establish an electrostatic trapping field that has causes the ion to undergo harmonic motion with respect to a longitudinal axis of the trap. The apparatus further includes a detector that generates a time-varying signal representative of the current induced on the detector by the harmonic longitudinal motion of the ion. A data system receives the time-varying signal from the detector, and processes the signal to derive its frequency and amplitude. The data system is further configured to determine the ion's m/z from the derived frequency, and to determine the ion's charge from the derived amplitude.

In more specific embodiments, the electrostatic trap is formed from coaxially arranged inner and outer electrodes, each elongated along a longitudinal axis, and the ion is trapped in the annular space between the electrodes. The inner and outer electrodes may be shaped and arranged to establish a quadro-logarithmic field in the annular space, such that the restorative force exerted by the field along the central axis is proportional to the position of the ion along the central axis relative to a transverse plane of symmetry. The outer electrode may be split in half along the transverse plane of symmetry into first and second parts, and the detector may comprise a differential amplifier connected across the first and second parts. The data system may derive the frequency and amplitude of the detector signal by applying a fast Fourier transform (FFT) routine to convert the signal from the time to the frequency domain. The ion may be trapped in an ion store prior to release to the electrostatic trap to reduce its kinetic energy and promote complete desolvation. Analysis of two or more ion species may be performed simultaneously within the electrostatic trap, such that the data system processes the signal produced by the motion of the two or more ion species to derive multiple peaks, each peak having an associated frequency and amplitude and corresponding to a different one of the ion species.

In accordance with another embodiment, a method is provided for determining the m/z and charge of an ion of interest. The method includes injecting an ion population including the ion of interest into a trapping region, and establishing an electrostatic trapping field within the region that causes the ion population to undergo harmonic motion along a central axis. A time-varying signal, representative of the current induced on a detector by the harmonic motion of the ion population, is processed to derive a frequency and an amplitude associated with the ion of interest. The m/z and charge of the ion of interest may then be determined respectively from the derived frequency and amplitude.

In more specific implementations of the foregoing method, the electrostatic field may be established in an annular region between an inner and outer electrode, and the electrostatic trapping field may be a quadro-logarithmic field. The ion of interest may be a protein, protein complex, viral capsid, or high molecular weight polymer. The ion population may include two (or more) ions of interest, and the method may include deriving, from the time-varying signal, frequencies and amplitudes associated with each of the two ions of interest, and determining the m/z and charge state for each ion of interest from their respective derived frequencies and amplitudes.

DETAILED DESCRIPTION

Figure 1:
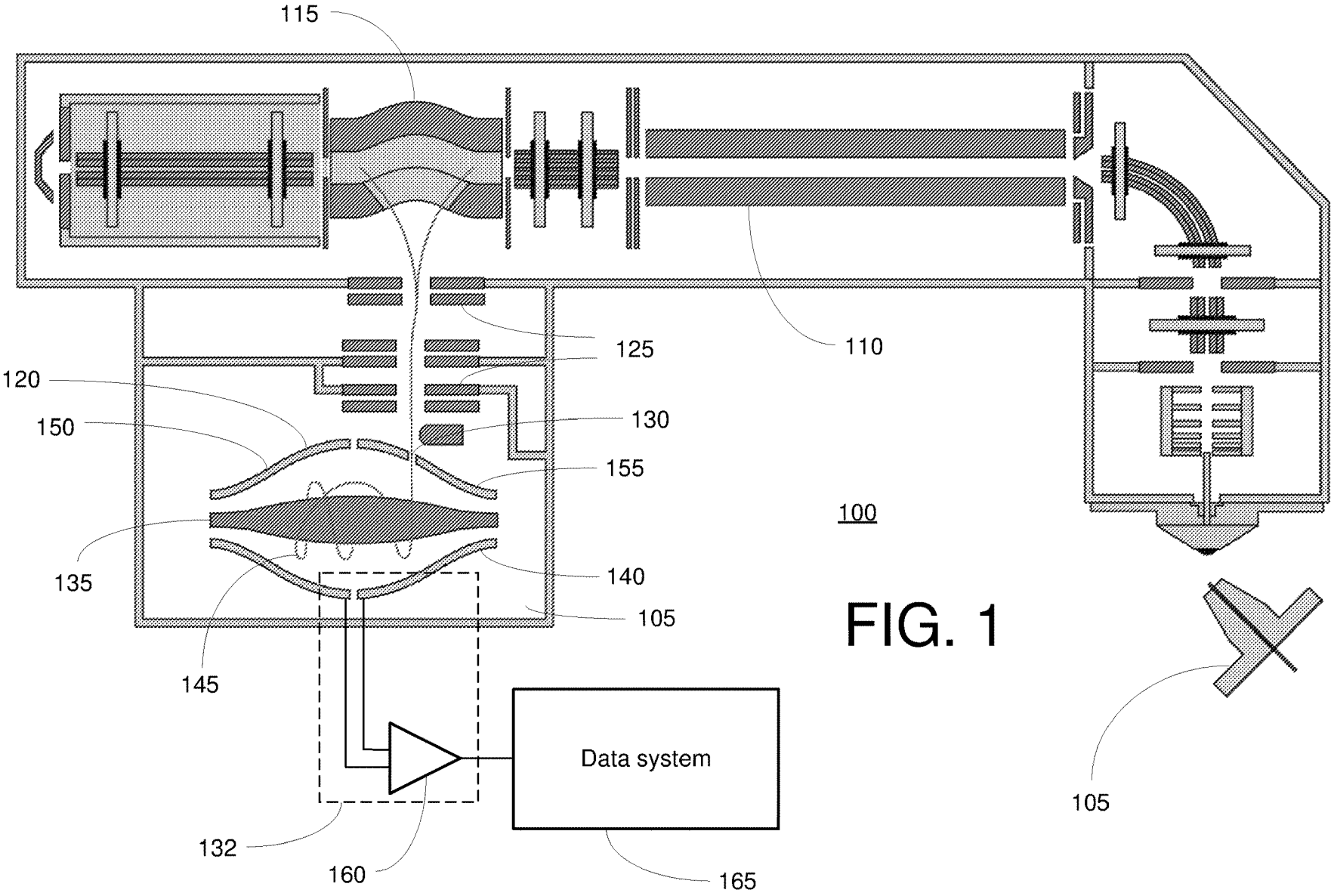
FIG. 1 is a symbolic diagram of an apparatus for concurrent measurement of the m/z and charge of an ion, in accordance with an embodiment of the invention.

FIG. 1 symbolically depicts a mass spectrometry apparatus 100 arranged in accordance with one embodiment of the present invention. Apparatus 100 includes an ionization source 105 that generates ions from a sample to be analyzed. As used herein, the term "ion(s)" refers to any charged molecule or assembly of molecules, and is specifically intended to embrace high molecular weight entities sometimes referred to in the art as macroions, charged particles, and charged aerosols. Without limiting the scope of the invention, ions that may be analyzed by apparatus 100 include proteins, protein complexes, antibodies, viral capsids, oligonucleotides, and high molecular weight polymers. Source 105 may take the form of an electrospray ionization (ESI) source, in which the ions are formed by spraying charged droplets of sample solution from a capillary to which a potential is applied. The sample may be delivered to source 105 as a continuous stream, e.g., as the eluate from a chromatographic column.

Ions generated by source 105 are directed and focused through a series of ion optics disposed in vacuum chambers of progressively reduced pressures. As depicted in FIG. 1, the ion optics may include ion transfer tubes, stacked ring ion guides, radio-frequency (RF) multipoles, and electrostatic lenses. The vacuum chambers in which the ion optics are contained may be evacuated by any suitable pump or combination of pumps operable to maintain the pressure at desired values.

Apparatus 100 may additionally include a quadrupole mass filter (QMF) 110 that transmits only those ions within a selected range of values of m/z. The operation of quadrupole mass filters is well known in the art and need not be discussed in detail herein. Generally described, the m/z range of the selectively transmitted ions is set by appropriate adjustment of the amplitudes of the RF and resolving direct current (DC) voltages applied to the electrodes of QMF 110 to establish an electric field that causes ions having m/z's outside of the selected range to develop unstable trajectories. The transmitted ions may thereafter traverse additional ion optics (e.g., lenses and RF multipoles) and enter ion store 115. As is known in the art, ion store 115 employs a combination of oscillatory and static fields to confine the ions to its interior. In a specific implementation, ion store 115 may take the form of a curved trap (referred to colloquially as a "c-trap") of the type utilized in Orbitrap mass spectrometers sold by Thermo Fisher Scientific. The curved trap is composed of a set of generally parallel rod electrodes that are curved concavely toward the ion exit. Radial confinement of ions within ion store 115 may be achieved by applying oscillatory voltages in a prescribed phase relationship to opposed pairs of the rod electrodes, while axial confinement may be effected by applying static voltages to end lenses positioned axially outwardly of the rod electrodes.

Ions entering ion store 115 may be confined therein for a prescribed cooling period in order to reduce their kinetic energies prior to introduction of the ions into electrostatic trap. Confinement of the ions within the ion store for a prescribed period may also assist in desolvation of the ions, i.e., removal of any residual solvent moieties from the analyte ion. As discussed hereinabove, the presence of residual solvent may result in mass shifts during analysis which interfere with the ability to accurately measure m/z and charge. To facilitate kinetic cooling and desolvation of the ions, an inert gas such as argon or helium may be added to the ion store internal volume; however, the cooling gas pressure should be regulated to avoid unintended fragmentation of the analyte ions and/or excessive leakage of the gas into electrostatic trap 120. The duration of the cooling period will depend on a number of factors, including the kinetic energy of ions entering ion store 115, the inert gas pressure, and the desired kinetic energy profile of ions injected into electrostatic trap 120. After the cooling period has been completed, ions confined in ion store 115 may be radially ejected from ion store toward entrance lenses 125, which act to focus and direct ions into inlet 130 of electrostatic trap 120. Rapid ejection of ions from ion store 115 toward the electrostatic trap inlet may be performed by rapidly collapsing the oscillatory field within the ion store interior and applying a DC pulse to the rod electrodes positioned away from the direction of ejection.

To accurately measure ion charge using the CDMS technique, only individual ions of a particular ion species can be present in electrostatic trap 120 during a measurement event. As used herein, the term "ion species" refers to an ion of a given elemental/isotopic composition and charge state; ions of different elemental compositions are considered to be different ion species, as well as are ions of the same elemental composition but different charge states. The term "ion of interest" is also used herein to designate a particular ion species. If multiple ions of the same ion species are present during a measurement event, then the measured charge state (determined from the amplitude of the signal generated by image current detector 132, as described below) will be a multiple of the actual charge state of an individual ion. To avoid this type of mismeasurement, the ion population within ion store 115 should be kept sufficiently small such that the likelihood that two ions of the same ion species are confined within the ion store is maintained at an acceptable minimum. This may be accomplished by attenuation of the ion beam generated by source 105 (more specifically, by "detuning" ion optics located in the upstream ion path such that high losses of ions occur) and/or via regulation of the fill time (the period during which ions are accepted into ion store 115). To control the fill time, one or more ion optic components located upstream in the ion path of ion store may be operated as a gate to selectively allow or block passage of ions into the internal volume of ion store 115.

Electrostatic trap 120 may take the form of an orbital electrostatic trap, of the type commercially available from Thermo Fisher Scientific under the trademark "Orbitrap" and depicted in cross-section in FIG. 1. Such orbital electrostatic traps include an inner spindle-type electrode 135 defining a central longitudinal axis, designated in a cylindrical coordinate system as the z-axis. An outer barrel-type electrode 140 is positioned coaxially with respect to inner electrode 135, defining therebetween a generally annular trapping region 145 into which ions are injected. Inner electrode 135 and outer electrode 140 are each symmetrical about a transverse plane (designated as z=0, and alternatively referred to as the "equator"), with inner electrode 135 having a maximum outer radius of $R_1$ and outer electrode 140 having a maximum inner radius of $R_2$ at the transverse plane of symmetry. As has been discussed widely in the scientific literature (see, e.g., Makarov, "Electrostatic Axially Harmonic Orbital Trapping: A High-Performance Technique of Mass Analysis", Analytical Chemistry, Vol. 72, No. 6, pp. 1156-62 (2000), which is incorporated herein by reference), the inner and outer electrodes may be shaped to establish an electrostatic potential U (upon application of electrostatic voltage(s) to one or both of the electrodes) within trapping region 145 that approximates the relation:

$$U(r, z) = \frac{k}{2}\left(z^2 - \frac{r^2}{2}\right) + \frac{k}{2} * (R_m) * \ln\left(\frac{r}{R_m}\right) + C$$

where r and z are cylindrical coordinates (r=0 being the central longitudinal axis and z=0 being the transverse plane of symmetry), C is a constant, k is field curvature, and Rm is the characteristic radius. This field is sometimes referred to as a quadro-logarithmic field.

Outer electrode 140 is split along the transverse plane of symmetry into first and second parts 150 and 155, which are separated from each other by a narrow insulating gap. This arrangement enables the use of outer electrode 140, together with differential amplifier 160, as an image current detector. The presence of an ion proximal to the outer electrode induces a charge (of a polarity opposite to that of the ion) in the electrode having a magnitude proportional to the charge of the ion. The oscillatory back-and-forth movement of an ion along the z-axis between the first 150 and second 155 parts of outer electrode 140 causes image current detector 132 to output a time varying signal (referred to as a "transient") having a frequency equal to the frequency of the ion's longitudinal oscillation and an amplitude proportional to the ion's charge.

Ions may be introduced tangentially into trapping region 145 through inlet aperture 130 formed in outer electrode 240. Inlet aperture 130 is axially offset (along the z-axis) from the transverse plane of symmetry, such that, upon introduction into trapping region 145, the ions experience a restorative force in the direction of the plane of symmetry, causing the ions to initiate longitudinal oscillation along the z-axis while orbiting inner electrode 135, as illustrated in FIG. 1. A salient characteristic of the quadro-logarithmic field is that its potential distribution contains no cross-terms in r and z, and that the potential in the z-dimension is exclusively quadratic. Thus, ion motion along the z-axis may be described as a harmonic oscillator (because the force along the z-dimension exerted by the field on the ion is directly proportional to the displacement of the ion along the z-axis from the transverse plane of symmetry) and is completely independent of the orbital motion. In this manner, the frequency of ion oscillation ω along the z-axis is simply related to the ion's mass-to-charge ratio (m/z) according to the relation:

$$\omega = \sqrt{\frac{k}{m/z}}$$

Measurement of charge state and m/z, and consequent calculation of the product mass, proceeds by the acquisition and processing of the transient. Transient acquisition by detector 132 is initiated promptly after injection of the analyte ion(s), and continued for a predetermined transient length. The transient length required for accurate measurement of m/z and charge state will vary according to the analyte, as well as the physical and operational parameters of electrostatic ion trap 120. In general, the transient will need to be of adequate duration to allow the signal to be reliably distinguished from noise. For a typical analyte ion, it is anticipated that a satisfactory signal-to-noise ratio may be achieved using a commercially-available orbital trapping mass analyzer at a transient length of 500 milliseconds. It will be understood that the maximum transient length will be limited by the duration for which the analyte ion is stably trapped within trapping region 145 without colliding with background gas atoms/molecules or other ions, which is in part a function of the trapping region pressure.

The transient signal produced by detector 132 is processed by data system 165, the functions of which will be described below in connection with FIG. 2. Although data system 165 is depicted as a unitary block, its functions may be distributed among several interconnected devices. Data system 165 will typically include a collection of specialized and general purpose processors, application specific circuitry, memory, storage, and input/output devices. Data system 165 is configured with logic, for example using executable software code, to perform a set of calculations to determine the fundamental frequency of the analyte ion's motion and the amplitude of the image current generated by the ion, which values are used in turn to derive the m/z and charge state.

Figure 2:
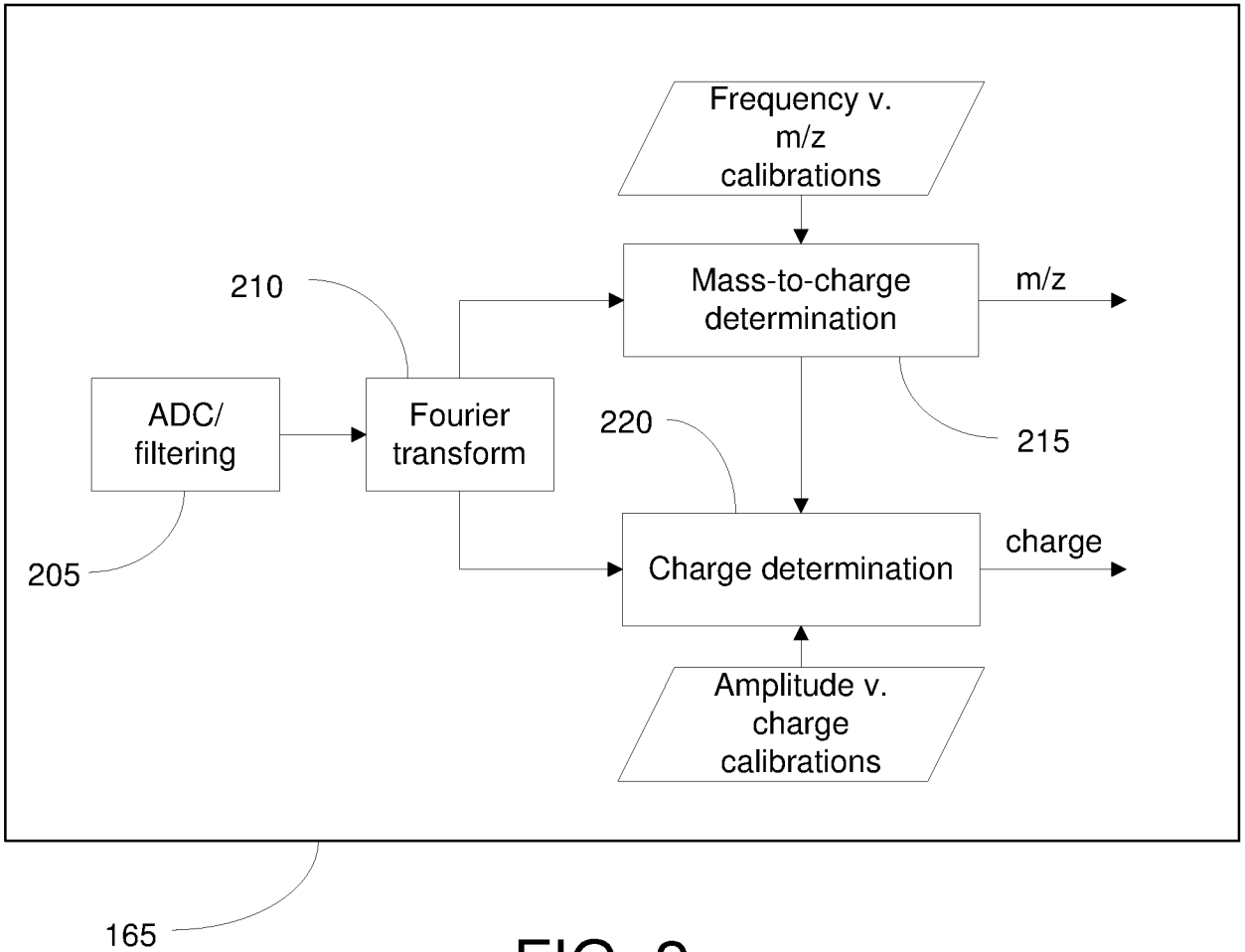
FIG. 2 is a block diagram depicting logical components of the data system of FIG. 1.

FIG. 2 depicts components of data system 165. Analog-to-digital converter (ADC) module 205 receives the analog signal generated by detector 132 and samples the signal at a prescribed sampling rate to generate a sequence of discrete time-intensity data values. ADC module 205 may also performing a filtering function to attenuate extraneous noise and improve signal-to-noise ratio. The time-domain data are then passed to Fast Fourier transform (FFT) module 210 for conversion of the data into the frequency domain. FFT algorithms are well known in the art and hence need not be discussed in detail herein. Generally described, an FFT algorithm rapidly computes the discrete Fourier transform (DFT) of a sequence by factorizing the DFT matrix into a product of sparse factors. FFT module 210 generates as output a frequency spectrum, representing the decomposition of the time-domain data sequence into one or more frequency components, each frequency component comprising a single sinusoidal oscillation with its own amplitude.

As noted above, the motion along the z-axis of an analyte ion trapped within the field generated in trapping region 145 is harmonic and may be represented as a simple sinusoidal function. The output of FFT module 210 will thereby yield a frequency spectrum that has a strong peak of amplitude A at the fundamental frequency of oscillation w of the ion being analyzed. When multiple ion species are present within the electrostatic trap during the measurement event (i.e., during acquisition of a transient), then each ion species will exhibit a corresponding peak in the frequency spectrum. In contrast to prior art CDMS systems in which the oscillatory motion of a trapped ion is anharmonic and non-sinusoidal (for which the FFT output will include numerous peaks distributed among various components), the signal for each ion species in the electrostatic trap 120 will be concentrated into a single peak appearing at the fundamental frequency of oscillation, thereby improving sensitivity and enabling charge measurement for lower-charge ions relative to prior art CDMS devices.

The frequency spectrum generated by FFT module 210 is provided as input to m/z determination module 215 and charge determination module 220, which process the frequency spectrum to respectively determine the m/z and charge of the analyte ion(s). M/z determination module 215 is configured to identify, for the or each analyte ion species present in the spectrum, the fundamental frequency of oscillation of the analyte ion. This frequency is then converted to a value of m/z. As noted above, the frequency of oscillatory ion motion along the z-axis is inversely proportional to the square root of the ion's m/z in accordance with the relation:

$$\omega = \sqrt{\frac{k}{m/z}}$$

Thus, the m/z may be determined from the measured ion frequency using an empirically established frequency vs. m/z calibration curve generated by fitting an inverse square-root curve to data points acquired for analyte ions of known m/z, as is known in the art.

Figure 3:
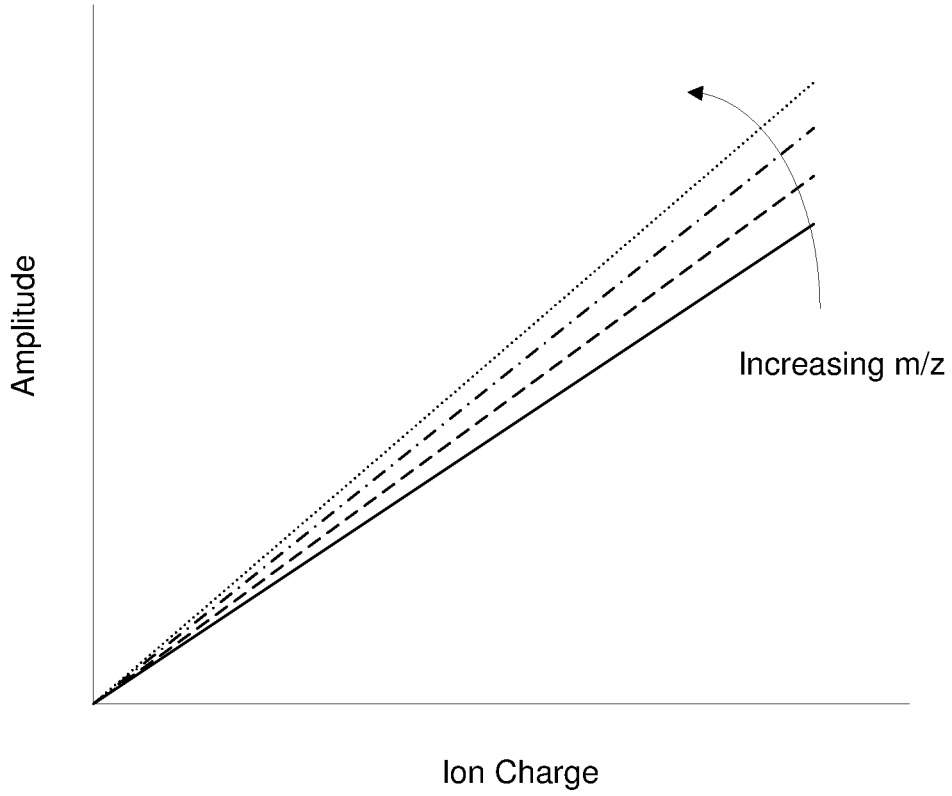
FIG. 3 is a graph depicting the postulated influence of m/z on the relation between charge and peak amplitude.

Charge determination module 220 is configured to process the frequency spectrum and provide as output, for the or each analyte ion species present in the spectrum, a value of the ion's charge. This operation is performed by determining the amplitude of the peak corresponding to the analyte ion's fundamental frequency of oscillation and converting the amplitude to a charge value in accordance with a predetermined relation between measured amplitude and charge. This relation may be established empirically using a curve fit to amplitude measurements acquired for calibrant ions of known m/z and charge. To a rough approximation, the relation between the peak amplitude and charge may be linear, since the charge induced on the detection electrodes by the motion of an ion will be equal and opposite to the ion's charge. However, for certain implementations of the invention, the relation between charge and peak amplitude may also be influenced, for a particular analyte ion, by the ion's m/z and initial kinetic energy. Referring to FIG. 3, for a given ion charge, the peak amplitude may be higher for an ion of higher m/z relative to an ion of lower m/z. This m/z dependence is attributable to the fact that the higher m/z ion will orbit the inner electrode at a greater average radial distance relative to the lower m/z ion, and the closer proximity of the higher m/z ion to the surfaces of the first and second outer electrode parts may induce a higher charge on the detector electrodes relative to the lower m/z ion. Thus, charge determination module 220 may accept as input both the peak amplitude and the ion m/z (as determined by m/z module 215 from the measured ion frequency), and calculate the ion charge based on a set of stored, empirically derived amplitude vs. charge calibration curves that establish the variation of amplitude vs. charge as a function of ion m/z.

In other implementations of the invention, charge determination module 220 may calculate charge based on a more complex relationship that takes into account instrument parameters, such as electrode voltages, that affect the initial kinetic energy of the analyte ion and may influence the relation between peak amplitude and ion charge (via changing the ion trajectory with respect to the detector electrodes). For this reason, it may be necessary to empirically construct calibration curves at a range of instrument parameters.

Once the m/z and charge of the analyte ion has been determined, the mass of the ion may be calculated simply via the product of the determined m/z and charge. If the spectrum contains multiple ion species, the mass for each ion species is calculated by the product of the m/z and charge determined for that species.

In certain implementations, the transient acquisition and m/z and charge determination steps will be performed repeatedly for an ion population (initially stored in the c-trap) that includes the analyte ion species. The resultant calculated masses may be binned to obtain a mass histogram, with the peak of the histogram representing the most likely mass. Generally, the width of the histogram will depend on the accuracy of the image charge determination, with narrower widths being indicative of high accuracy. Other techniques, including averaging, may be employed to improve the reliability of mass determination.

While the invention has been described above and depicted in the drawings in connection with its implementation in an orbital electrostatic trap having a quadrologarithmic trapping field, it should be understood that this implementation is described by way of an illustrative rather than a limiting example. The invention may be implemented in any electrostatic trap or equivalent structure in which the confined ions undergo harmonic motion along a longitudinal axis, including traps in which the ions do not undergo orbital motion. An example of a non-orbital electrostatic trap that may be suitable for implementation of the present invention is the Cassinian trap described in Köster, "The Concept of Electrostatic Non-Orbital Harmonic Ion Trapping", International Journal of Mass Spectrometry, V. 287, pp. 114-118 (2009), which is incorporated herein by reference.

Those skilled in the art will further recognize that the term "harmonic motion", as used herein, includes motion that includes small deviations from purely harmonic motion, but where such deviations are operationally insubstantial such that the motion is predominately harmonic (i.e., that it can be substantially accurately modeled as an oscillatory function having a single frequency). In any "real-world" electrostatic trap, the electric field will include faults arising from (for example), dimensional and alignment errors and electrode truncation, which cause the restoring force to depart slightly from being a linear function of the ion's position relative to the central plane of symmetry, in turn causing the ion's motion to deviate by a small amount from purely harmonic. Such motion should be construed as being within the scope of "harmonic motion", as set forth in the claims.

What is claimed is:

1. Apparatus for determination of a mass-to-charge ratio (m/z) and a charge of an ion, comprising:

an electrostatic trap having a plurality of electrodes and a voltage source for applying a set of non-oscillatory voltages to the plurality of electrodes, the plurality of electrodes being shaped and arranged to establish an electrostatic trapping field within the electrostatic trap that causes the ion to undergo harmonic motion along a longitudinal axis;

a detector that generates a time-varying signal responsive to a current induced on the detector by the harmonic motion of the ion; and a data system having logic for processing the time-varying signal to derive a frequency of harmonic motion and an amplitude at the harmonic motion frequency, and to determine the m/z from the derived frequency and the charge from the derived amplitude;

wherein the plurality of electrodes includes an inner electrode elongated along the axis and an outer electrode radially surrounding the inner electrode, and wherein the electrostatic field is established in the annular space between the inner and outer electrodes.

2. The apparatus of claim 1, wherein the inner and outer electrodes are shaped and arranged such that the electrostatic field has a potential distribution that approximates the relation:

$$U(r, z) = \frac{k}{2}\left(z^2 - \frac{r^2}{2}\right) + \frac{k}{2} * (R_m) * \ln\left(\frac{r}{R_m}\right) + C$$

where r is the position of the ion along the radial axis, z is the position of the ion along the central axis, k is the field curvature, C is a constant, and $R_m$ is a characteristic field radius.

3. The apparatus of claim 1, wherein the outer electrode is split along a transverse plane of symmetry of the electrostatic trap into first and second parts, and the detector comprises a differential amplifier connected between the first and second parts.

4. The apparatus of claim 1, further comprising an ion store in which the ion is trapped and thereafter released on an ion path toward an inlet of the electrostatic trap.

5. The apparatus of claim 1, wherein the data system is configured to apply a Fourier transform to the time-varying signal to construct a frequency spectrum.

6. The apparatus of claim 1 wherein the time-varying signal generated by the detector is primarily sinusoidal.

7. The apparatus of claim 1, wherein the data system is configured to determine the charge in accordance with a stored empirically derived relationship adjusting for the ion's m/z.

8. A method for determining a mass-to-charge ratio (m/z) and a charge of an ion of interest, comprising:

(a) injecting an ion population including the ion of interest into a trapping region and establishing an electrostatic trapping field within the region that causes the ion population to undergo harmonic motion along a central axis;

(b) generating a time-varying signal representative of a current induced on a detector by the harmonic motion of the ion population;

(c) processing the time-varying signal to derive a frequency and an amplitude of the induced current; and (d) determining the m/z of the ion of interest from the derived frequency and the charge from the derived amplitude;

wherein the electrostatic field is established in an annular region between an inner electrode and an outer electrode radially surrounding the inner electrode, and wherein the electrostatic trapping field has a potential distribution that approximates the relation:

$$U(r, z) = \frac{k}{2}\left(z^2 - \frac{r^2}{2}\right) + \frac{k}{2} * (R_m) * \ln\left(\frac{r}{R_m}\right) + C$$

where r is the position of the ion along the radial axis, z is the position of the ion along the central axis, k is the field curvature, C is a constant, and $R_m$ is a characteristic field radius.

9. The method of claim 8, wherein the step of processing includes applying a Fourier transform to the time-varying signal.

10. The method of claim 8, wherein the ion of interest is one of: a protein, a protein complex, and a viral capsid.

11. The method of claim 8, wherein the ion of interest is a high molecular weight polymer.

12. The method of claim 8, further comprising performing repeated cycles of steps (a)-(d) and collecting the determined m/z and charge of the ion of interest for each cycle.

13. The method of claim 12, further comprising a step of constructing a histogram of calculated masses of the ion of interest from the collected determined m/z's and charges of the ion of interest.

14. The method of claim 8, wherein the ion population includes a second ion of interest, and further wherein the step of processing the time varying signal derives a first frequency and a first amplitude associated with the ion of interest and a second frequency and a second amplitude associated with the second ion of interest, and further including determining the m/z of the second ion of interest from the second frequency and the charge of the second ion of interest of the second amplitude.

15. The apparatus of claim 1, further comprising ion optics located in an ion path upstream of the electrostatic trap configured to attenuate the beam of ions directed toward the electrostatic trap.

16. The method of claim 8, further comprising a step of attenuating a beam of ions directed toward the trapping region.

17. The method of claim 8, wherein the ion population is confined in an ion store prior to injection into the trapping region.

* * * * *